US006129139A

United States Patent [19]

De Clerc

[11] Patent Number: 6,129,139

[45] Date of Patent: Oct. 10, 2000

[54] CONSOLIDATED POPPET VALVE ASSEMBLY

[75] Inventor: John D. De Clerc, Green Bay, Wis.

[73] Assignee: Megtec Systems Inc., DePere, Wis.

[21] Appl. No.: 09/103,346

[22] Filed: Jun. 23, 1998

[51] Int. Cl.[7] ..... F23L 15/02

[52] U.S. Cl. ..... 165/9.3; 165/4; 165/10; 137/309

[58] Field of Search ..... 165/4, 9.3, 10; 137/309, 311; 110/236, 211, 233; 422/175, 168, 182

[56] References Cited

U.S. PATENT DOCUMENTS

| | | | |
|---|---|---|---|
| 389,671 | 9/1888 | Swindell | 137/309 |
| 634,907 | 10/1899 | Newell | 137/309 |
| 837,666 | 12/1906 | Clausen | 137/309 |
| 878,213 | 2/1908 | Longenecker | 137/309 |
| 1,521,298 | 12/1924 | Isley | 137/309 |
| 2,737,970 | 3/1956 | Hasche et al. | 137/309 |
| 3,384,358 | 5/1968 | Morton | 165/9.3 |
| 3,870,474 | 3/1975 | Houston | 23/277 |
| 3,897,800 | 8/1975 | Tyrner et al. | 137/309 |
| 4,088,180 | 5/1978 | Tsai | 165/9.3 |
| 4,248,841 | 2/1981 | Benedick | 423/210 |
| 4,252,070 | 2/1981 | Benedick | 110/211 |
| 4,280,416 | 7/1981 | Edgerton | 110/254 |
| 4,345,639 | 8/1982 | Lane | 165/10 |
| 4,349,069 | 9/1982 | von Beck | 165/4 |
| 4,658,853 | 4/1987 | Pennington | 137/240 |
| 4,793,974 | 12/1988 | Hebrank | 422/175 |
| 5,000,422 | 3/1991 | Houston | 251/306 |
| 5,016,547 | 5/1991 | Thomason | 110/211 |
| 5,101,741 | 4/1992 | Gross et al. | 110/233 |
| 5,129,332 | 7/1992 | Greco | 110/233 |
| 5,134,945 | 8/1992 | Reimlinger et al. | 110/304 |
| 5,515,909 | 5/1996 | Tanaka | 165/10 |
| 5,695,002 | 12/1997 | Tanaka et al. | 165/10 |

*Primary Examiner*—Ira S. Lazarus
*Assistant Examiner*—Terrell McKinnon
*Attorney, Agent, or Firm*—Mitchell D. Bittman; Kevin Lemack

[57] ABSTRACT

Anti-leak two-port and three-port poppet valves for a regenerative thermal oxidizer in which a gas such as contaminated air is first passed through a hot heat-exchange bed and into a communicating high temperature oxidation (combustion) chamber or zone, and then through a relatively cool second heat exchange bed. The alternating of the heat transfer zones to provide matrix regeneration is accomplished via regenerative thermal oxidizer switching valves. In the preferred embodiment of the present invention, the switching valves are horizontal pneumatic poppet type valves in a consolidated housing, the valve's switching frequency or cycle being a function of volumetric flow rate.

7 Claims, 5 Drawing Sheets

CONSOLIDATED POPPET VALVE ASSEMBLY

BACKGROUND OF THE INVENTION

The control and/or elimination of undesirable impurities and by-products from various manufacturing operations has gained considerable importance in view of the potential pollution such impurities and by-products may generate. One conventional approach for eliminating or at least reducing these pollutants is by oxidizing them via incineration. Incineration occurs when contaminated air containing sufficient oxygen is heated to a temperature high enough and for a sufficient length of time to convert the undesired compounds into harmless gases such as carbon dioxide and water vapor.

In view of the high cost of the fuel necessary to generate the required heat for incineration, it is advantageous to recover as much of the heat as possible. To that end, U.S. Pat. No. 3,870,474 discloses a thermal regenerative oxidizer comprising three regenerators, two of which are in operation at any given time while the third receives a small purge of purified air to force out any untreated or contaminated air therefrom and discharges it into a combustion chamber where the contaminants are oxidized. Upon completion of a first cycle, the flow of contaminated air is reversed through the regenerator from which the purified air was previously discharged, in order to preheat the contaminated air during passage through the regenerator prior to its introduction into the combustion chamber. In this way, heat recovery is achieved.

U.S. Pat. No. 3,895,918 discloses a thermal regeneration system in which a plurality of spaced, non-parallel heat-exchange beds are disposed toward the periphery of a central, high-temperature combustion chamber. Each heat-exchange bed is filled with heat-exchanging ceramic elements. Exhaust gases from industrial processes are supplied to an inlet duct, which distributes the gases to selected heat-exchange sections depending upon whether an inlet valve to a given section is open or closed.

Various valving systems have been disclosed in the art for such regeneration incinerators. For example, U.S. Pat. No. 4,658,853 discloses a butterfly-type valve subassembly positioned in an incineration system duct communicating with a source of gaseous effluents and at least one heat-exchange section. The subassembly has a planar member with at least one peripheral groove formed on at least one principal surface thereof. In the nominally closed valve position, the groove or grooves are positioned to be in communication with grooves in corresponding valve seat members inside the subassembly housing. The grooves are the terminations of passageways that are adapted to be coupled to sources of pressurized gases for preventing the flow of gases past the planar member when the valve is nominally closed.

Similarly, U.S. Pat. No. 4,252,070 discloses a double valve anti-leak system for thermal regeneration incinerators wherein double valves are provided in series at the inlet and/or outlet to each heat-exchange section. Leakage is minimized by using inlet and exhaust valves in sets of two, which produces a double pressure drop across them so that there is a lessened negative pressure produced by the exhaust fan, and therefore a lesser probability of leakage. However, this approach requires the use of twice the typical double number of valves and appurtenant controls.

U.S. Pat. No. 5,000,422 discloses a leakage control system that conducts leakage back to an incinerator for oxidation or provides a pressure differential that precludes leakage of emissions past the control valves. A circular butterfly valve is provided that is rotatable about an axis extending diametrically of a cylindrical valve housing. The butterfly has two axially spaced seal surfaces on the periphery that, in conjunction with complementary axially spaced seats on the valve housing, control the flow of air to or from an annular plenum that surrounds the valve housing.

U.S. Pat. No. 4,280,416 discloses a rotary valve for controlling the flow of gases in a regenerative thermal reactor. Slots formed on a rotating plate allow communication of the purging, exhaust and inlet ducts with selective heat-exchange chambers.

It would be desirable to provide suitable valving for thermal oxidizers and the like that are economical to manufacture, easy to control, result in minimal or no leakage, and exhibit fast response times.

It is therefore an object of the present invention to provide valving to minimize or prevent leakage of unpurified effluent across the valves in thermal oxidizers.

It is a further object of the present invention to provide thermal oxidizer apparatus valving to minimize or prevent leakage of unpurified effluent across the valves in an economically efficient manner.

It is a still further object of the present invention to provide quick actuation valving in thermal oxidizer apparatus while minimizing or preventing leakage of unpurified effluent across the valves.

It is an even further object of the present invention to provide a consolidated poppet valve housing in modular format to allow for additional valve housings to be added to handle increased flow loads.

It is yet a still further object of the present invention to provide a consolidated poppet valve housing that reduces the necessary duct work for communication from the process gas source and to the regenerative thermal oxidizer apparatus.

SUMMARY OF THE INVENTION

The problems of the prior art have been solved by the present invention, which provides anti-leak two-port and three-port poppet valves for a regenerative thermal oxidizer in which a gas such as contaminated air is first passed through a hot heat-exchange bed and into a communicating high temperature oxidation (combustion) chamber or zone, and then through a relatively cool second heat exchange bed. The oxidizer apparatus in which the consolidated poppet valve of the present invention is preferably employed includes a number (preferably two) of internally insulated, ceramic filled heat recovery columns in communication with an insulated (preferably internally insulated) combustion chamber. Process air is fed into the oxidizer and directed into the heat exchange media in one of the heat exchange columns. The heat exchange media therein contains "stored" heat from a previous recovery cycle. As a result, the process air is heated to near oxidation temperatures. Any incomplete oxidation is completed as the flow passes through the combustion chamber, where one or more burners or the like are located. The gas is maintained at the operating temperature for an amount of time sufficient for completing destruction of the VOC's. Heat released during the oxidation process acts as a fuel to reduce (or eliminate) the required burner output. From the combustion chamber, the air flows through another column containing heat exchange media, thereby storing heat in that media for use in a subsequent inlet cycle when the flow control valves reverse. The resulting clean air is directed via an outlet valve through an outlet manifold and released to atmosphere at a slightly higher temperature than inlet, or is recirculated back to the oxidizer inlet.

With regenerative thermal oxidation technology, the heat transfer zones must be periodically regenerated to allow the heat transfer media (generally a bed of ceramic stoneware) in the depleted energy zone to become replenished. This is accomplished by periodically alternating the heat transfer zone through which the cold and hot fluids pass. Specifically, when the hot fluid passes through the heat transfer matrix, heat is transferred from the fluid to the matrix, thereby cooling the fluid and heating the matrix. Conversely, when the cold fluid passes through the heated matrix, heat is transferred from the matrix to the fluid, resulting in cooling of the matrix and heating of the fluid. Consequently, the matrix acts as a thermal store, alternately accepting heat form the hot fluid, storing that heat, and then releasing it to the cold fluid.

The alternating of the heat transfer zones to provide matrix regeneration is accomplished via regenerative thermal oxidizer switching valves. In the preferred embodiment of the present invention, the switching valves are horizontal pneumatic poppet type valves in a consolidated housing, the valve's switching frequency or cycle being a function of volumetric flow rate.

While the switching valves provide the means for matrix regeneration, the act of regeneration in itself results in a short duration emission of untreated fluid direct to atmosphere, causing a lowering of the volatile organic compound (VOC) destruction efficiency, and in cases involving high boiling point VOC's, potential opacity issues. To improve the VOC destruction efficiency and eliminate opacity issues resulting from matrix regeneration, the untreated fluid can be diverted away from the oxidizer stack and directed into a "holding vessel" or VOC entrapment chamber. The function of the entrapment chamber is to contain the slug of untreated fluid which occurs during the matrix regeneration process long enough so that the majority of it can be slowly recycled (i.e., at a very low flow rate) back to the inlet of the oxidizer for treatment. The untreated fluid in the entrapment chamber must be entirely evacuated and recycled back to the oxidizer inlet within the time frame allotted between matrix regeneration cycles since the process must repeat itself for all subsequent matrix regenerations.

A further advantage of the consolidated poppet valve housing in accordance with the present invention is the resulting geometry of the apparatus; it aligns geometrically with an integrated VOC entrapment chamber integral with and positioned directly over the combustion chamber, thereby eliminating substantial duct work and providing economy of space.

DETAILED DESCRIPTION OF THE INVENTION

The present invention provides a single consolidated poppet valve housing, in modular form, in contrast to the conventional apparatus where two separate independent poppet valve housings were required. The consolidated design of the present invention allows a single streamlined assembly which provides easier installation. The consolidated design also provides superior flow distribution into (and out of) the thermal oxidizer heat recovery columns and minimizes poppet valve-to-oxidizer heat recovery column transition duct work, thereby resulting in lower cost and reduced space requirements. The consolidated poppet valve housing is in modular form, thereby readily allowing the addition of additional consolidated housings to handle increased process gas flow loads.

Figure 1:
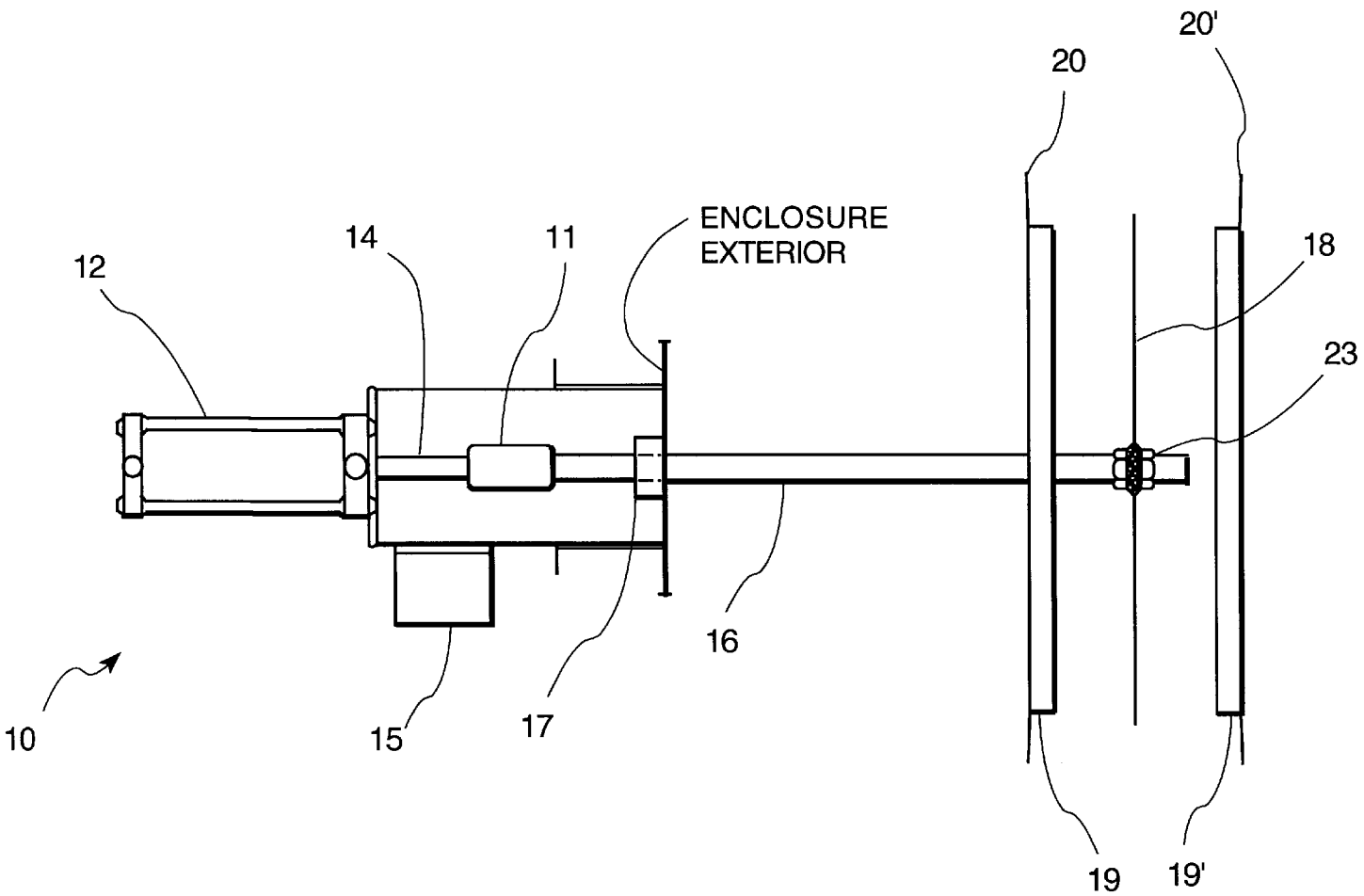
FIG. 1 is a cross-sectional view of a horizontal poppet valve in accordance with the present invention.

Turning first to FIG. 1, there is shown a cross-sectional view of a horizontal poppet valve 10 for use in accordance with the present invention. The valve 10 includes a double acting cylinder 12 coupled to piston rod 14 and driven by solenoid 15. The piston rod 14 is in turn coupled to actuating shaft 16 sealed from the rod housing by shaft seal 17. Shaft seal 17 is mounted on the exterior housing and seals the exhaust gases from exiting into the cylinder area. Preferably the actuating shaft 16 is made from stainless steel round bar and is threaded at both ends. One end is connected to the dual acting cylinder 12 through the exterior housing via a linear alignment coupling 11. At the distal end of the actuating shaft 16 relative to the cylinder 12 is a disk 18 which seals against either of rolled angle flange damper seats 19, 19', depending upon the valve open or closed position. Adjustment nuts 23 are provided on either side of disk 18. Damper seats 19, 19' are affixed against internal plate steel walls 20, 20' as shown. The actuating shaft 16 is supported in the integrated exhaust area by a V-grooved wheel from the bottom and a pinch roller from the top to retain the shaft on the V-grooved wheel. The position of disk 18 in FIG. 1 is in an intermediate position between the seats 19, 19'.

Figure 2:
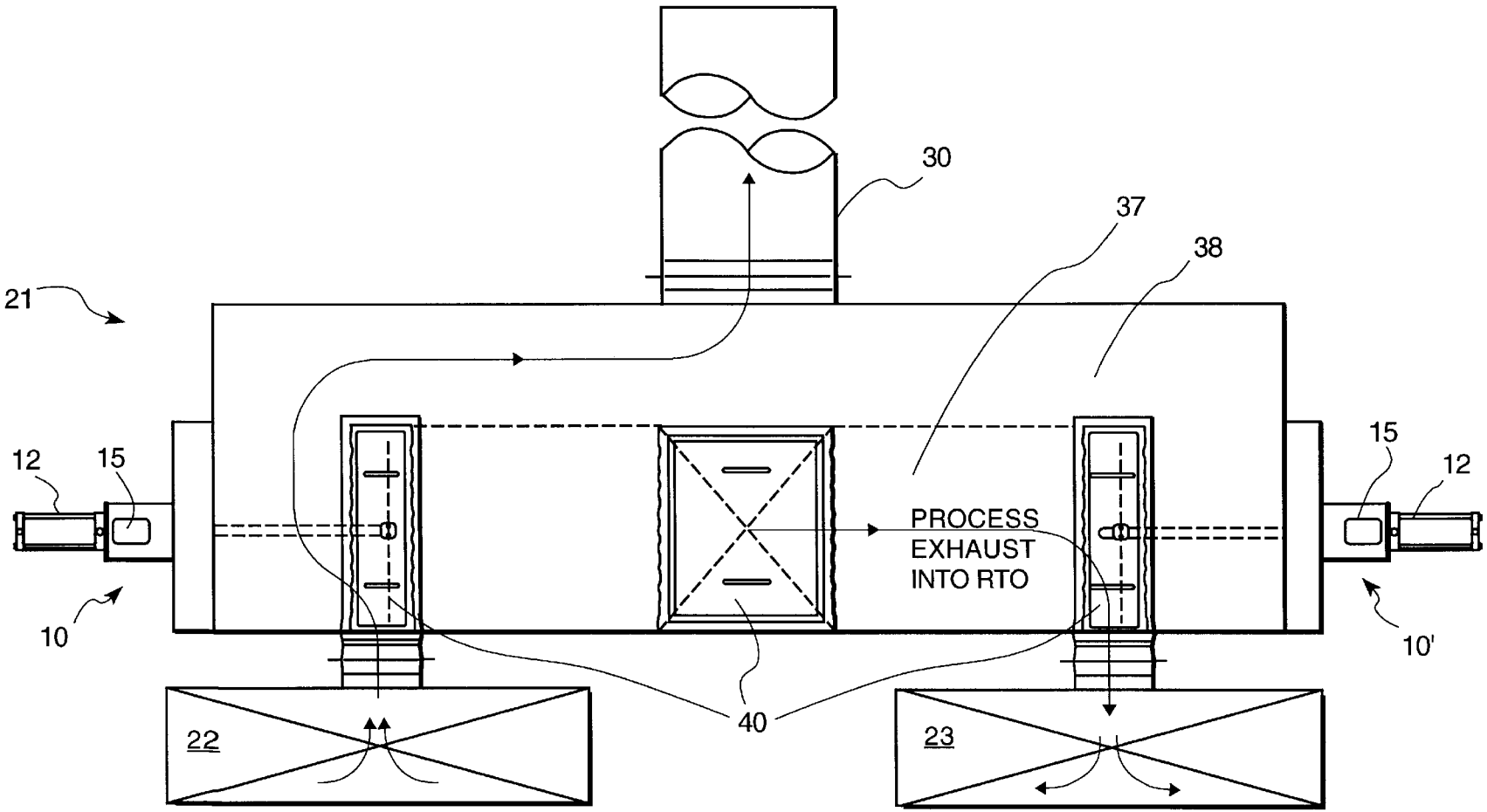
FIG. 2 is a cross-sectional view of the consolidated poppet valve housing including two horizontal poppet valves.
Figure 3:
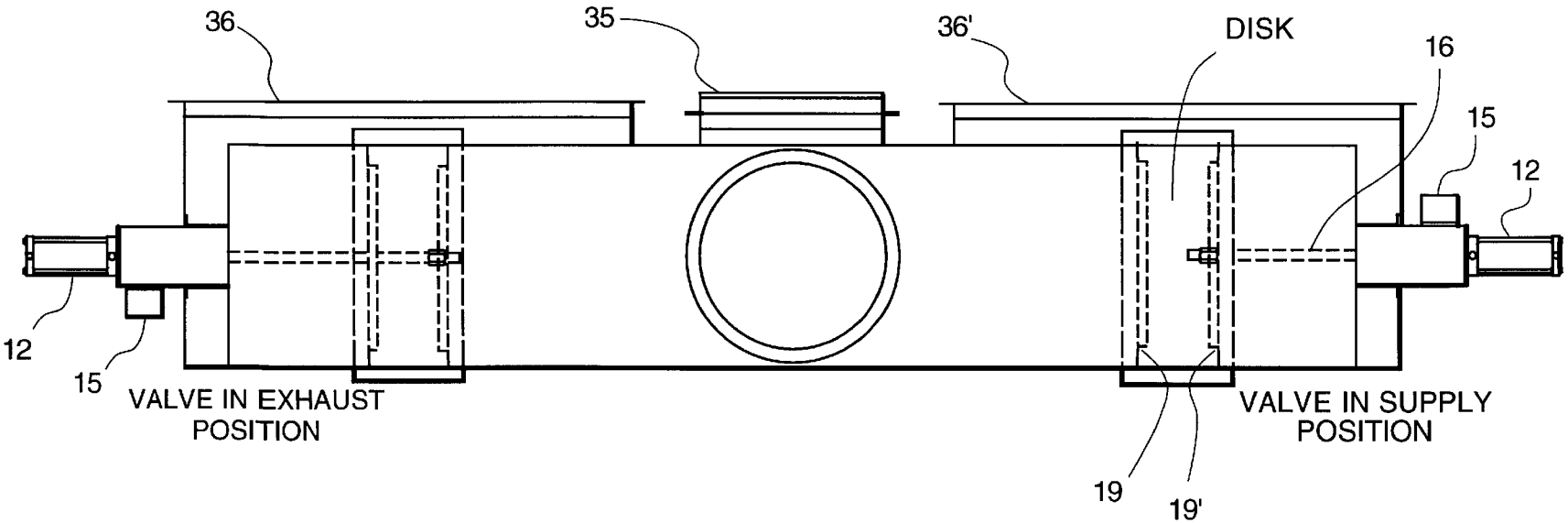
FIG. 3 is a top view of the consolidated poppet valve housing of FIG. 2.

Turning next to FIGS. 2 and 3, the consolidated housing 21 is shown containing two horizontal poppet valves 10, 10'. The assembly is mirrored to create opposing valve assemblies having a common process duct. The housing is in fluid communication with exhaust stack 30. Interconnecting duct work plenums 22, 23 each communicate with a respective poppet valve 10, 10'. The plenums 22, 23 are also in fluid communication with thermal oxidizer heat exchange beds (not shown) through suitable duct work. The heat exchange columns each communicate with a (generally common) combustion chamber as is conventional in the art. Access doors 40 are provided for maintenance, etc. As best seen in FIG. 3, a process air inlet flange 35 is centrally located in the housing 21 allowing process gas to communicate with the housing. Similarly, plenum flanges 36, 36' are provided in the housing 21 allowing fluid communication between the housing 21 and the regenerative thermal oxidizer.

The consolidated horizontal poppet valve of the present invention thus has an integrated exhaust stack 30 and actuating cylinders (typically two) in the horizontal plane. Each of the valves are arranged at a 180° angle with respect to one another and direct the incoming air into and out of the regenerative oxidizer system. The assembly has a common inlet duct as well as a common integrated outlet duct.

In operation, as seen from the flow arrows in FIG. 2, in a first mode regenerative thermal oxidizer exhaust flows into the housing 21 through plenum 22. Valve 10 is appropriately actuated into the exhaust position, so that the gas flow passes out of the housing 21 through integrated exhaust stack 30 via the integrated exhaust duct 38, and not into the common process inlet duct 37. Thus, disk 18 of poppet valve 10 is actuated into its fully extended position, preventing communication with between the valve and the duct 37. In contrast, valve 10' is in the supply position, wherein disk 18' is in its fully retracted position, allowing communication with common process duct 37. Thus, process exhaust flows into the regenerative thermal oxidizer via valve 10' and plenum 23 as shown. In a second mode, the valve positions are reversed, with valve 10 being in the supply position and valve 10' being in the exhaust position.

Figure 4:
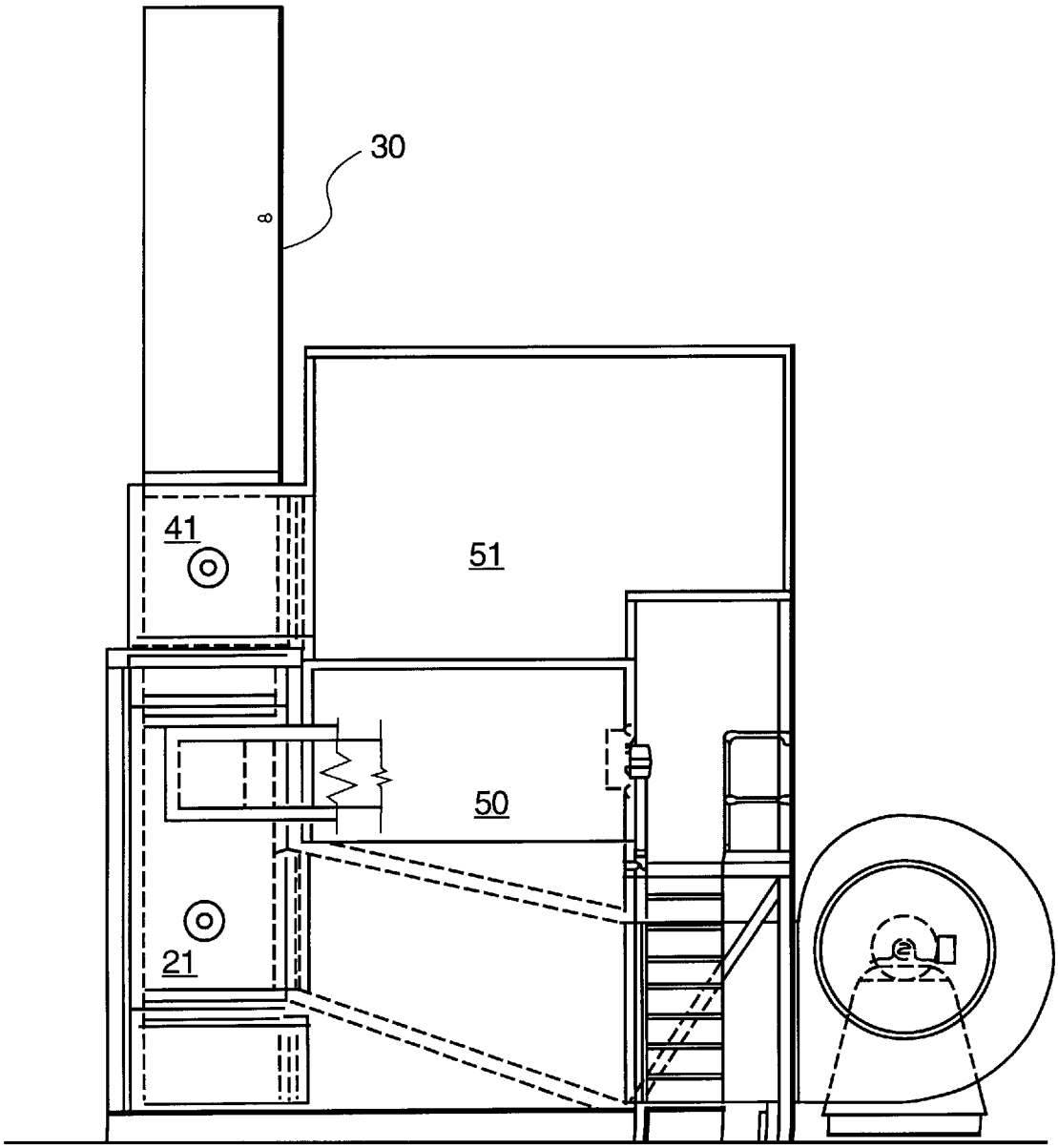
FIG. 4 is a schematic view of a preferred embodiment of the present invention incorporated into a regenerative thermal oxidizer.

In a preferred embodiment of the present invention, the consolidated poppet valve assembly 21 is used in conjunction with a regenerative thermal oxidizer that utilizes an integrated VOC entrapment chamber. Specifically, as shown in FIG. 4, situated preferably on top of the combustion chamber 50 of the regenerative thermal oxidizer is a VOC entrapment chamber 51 that entraps any VOC's that leak out during cycling of the system. The roof of the combustion chamber 50 also serves as the floor of the entrapment chamber 51, resulting in a compact, integrated design. Preferably the shape of the entrapment chamber 51 follows the same general contour as the combustion chamber 50. The height of the entrapment chamber 51 is generally higher than that of the combustion chamber, since it is dependent on different criteria. Specifically, the height of the combustion chamber 50 is a function of fluid velocity, whereas the height of the entrapment chamber 51 is a function of untreated fluid volume, pressure drop, untreated fluid temperature, and dwell time. For example, the entrapment chamber height can be 72 inches at an untreated fluid temperature of 100° F., and 96 inches at an untreated fluid temperature of 350° F. The untreated fluid volume is in turn directly related to the size of the oxidizer heat exchanger matrix, the matrix void volume, the switching valve switch time, and the size of the switch valve to heat exchanger zone connecting duct work. To insure that the entrapment chamber size is adequate, the chamber is preferably sized to contain a volume which is approximately 1.5 times greater than the untreated fluid volume. A flush return poppet valve and associated flush return duct work recycle the fluid in the entrapment chamber 51 back to the oxidizer inlet.

Figure 5:
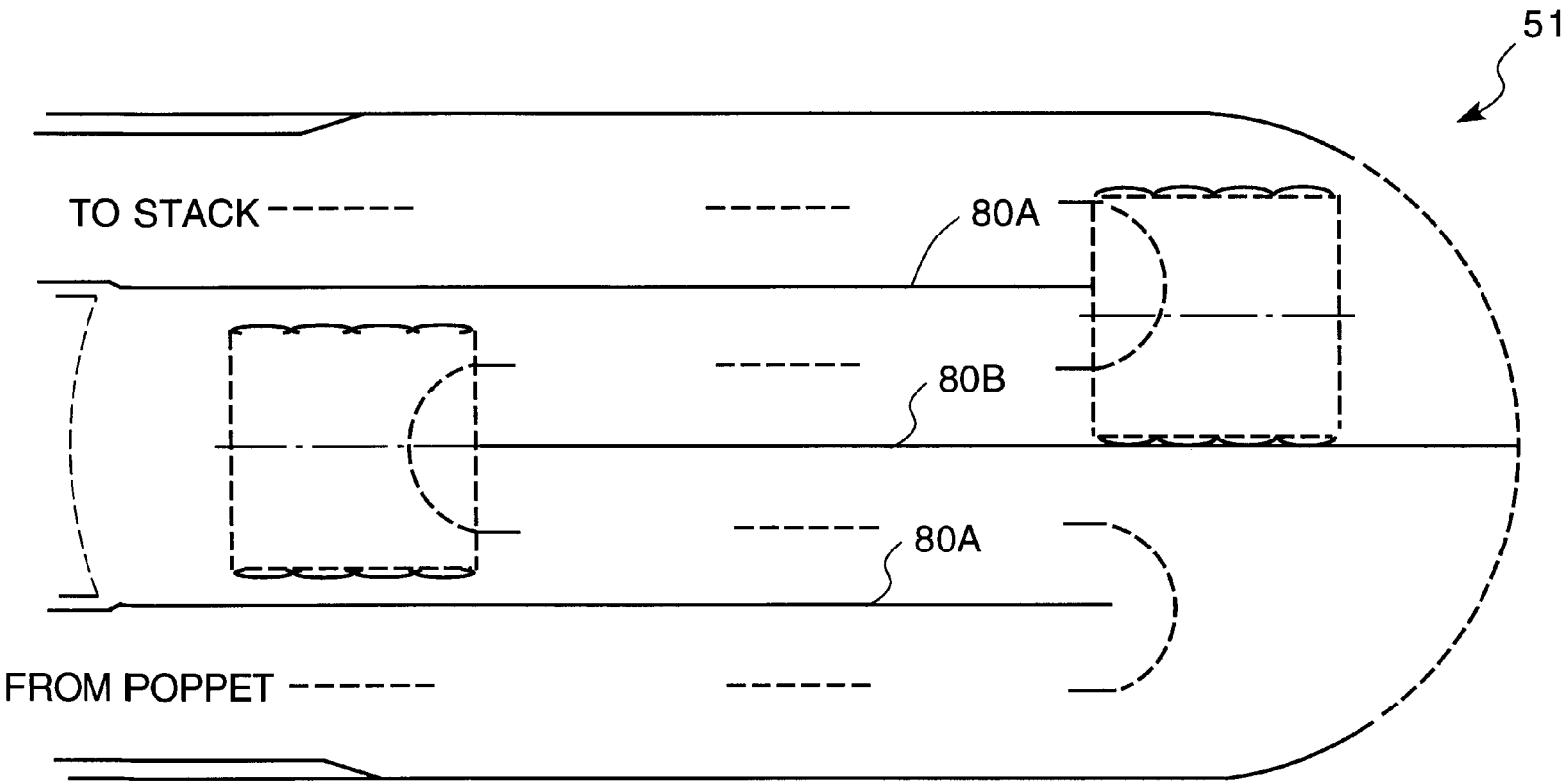
FIG. 5 is a top view of a VOC entrapment chamber in accordance with one embodiment of the present invention.

In addition to its volume capacity, the design of the entrapment chamber 51 internals is critical to its ability to contain and return the untreated fluid back to the oxidizer inlet for treatment within the time allotted between heat exchanger matrix regeneration cycles. Any untreated volume not properly returned within this cycle will escape to atmosphere via the exhaust stack 30, thereby reducing the effectiveness of the entrapment device, and reducing the overall efficiency of the oxidizer unit. Turning now to FIG. 5, there is shown a schematic top plan view of the entrapment chamber 51. A plurality of splitter plates **80*a*–80*n* running from top to bottom are located in the chamber 51 and divide the entrapment chamber 51 into a tortuous or meandering fluid flow pattern. Preferably an even number of meandering flow paths are created by the splitter plates so that the entrapment chamber inlet and outlet connections are on the same side of the oxidizer unit, which keeps the entrapment chamber 51 outlet on the same side of the oxidizer unit as the exhaust stack 30 with which it is in communication (since it must be under atmospheric pressure to allow for evacuation of the fluid contained within it), making for a very compact design. The number of meandering flow paths is restricted not only by the physical size of the chamber 51, but also by the resulting fluid pressure drop; a minimum fluid pressure drop is desired. Thus, the number and cross sectional area of the paths within the meandering flow patterns are preferably designed for a maximum fluid pressure drop of 2.0" w.c., and for a fluid velocity of approximately 39.0 acfm (at 100° F. to 350° F.) with a corresponding minimum dwell time of 3.0 seconds. Preferably six meandering flow paths are created. The meandering flow paths effectively lengthen the chamber so as to create a plugged flow design by increasing the dwell time of the fluid within the chamber 51. The larger the chamber volume capacity, and the longer the dwell time, the better the recycle-to-escape ratio of the untreated fluid. The time available to completely empty the entrapment chamber 51 is limited, and is dictated by the time duration between valve switches for matrix regeneration, which is generally about 240 seconds. Any untreated fluid in the entrapment chamber 51 that is not recycled escapes to atmosphere through the exhaust stack 30 via natural stack draft. The untreated flow in the entrapment chamber 51** must be returned to the oxidizer at a small volumetric flow rate (i.e., at a rate of approximately 2.0% of the total process exhaust flow rate entering the oxidizer) so that the size and electrical consumption of the oxidizer is not adversely affected.

As seen in FIG. 4, situated on top of consolidated poppet valve housing 21 is a second consolidated housing 41 in communication with consolidated housing 21 and entrapment chamber 51. In this embodiment, exhaust stack 30 is actually integrated into the top consolidated housing 41 rather than housing 21, and remains in fluid communication with housing 21 through housing 41. The assembly of FIG. 4 results in a compact design, allowing improved flow distribution into the associated oxidizer heat recovery columns, a reduction in duct work, thereby resulting in lower cost and reduced space requirements, and the flexibility to add additional modular valving where the flow considerations dictate the same. For example, the expandability of the design allows for the accommodation of variations in volumetric flow, ranging from about 10,000 to about 70,000 SCFM, simply by adding additional modular units. The valving in communication with the entrapment chamber is suitably timed to actuate depending upon the actuation of the valving in communication with the inlet and the outlet of the oxidizer.

What is claimed is:

1. A consolidated poppet valve assembly comprising a valve housing having process gas inlet means and process gas outlet means and a plurality of poppet valves, each of said poppet valves having independent means for actuation between a first position in communication with said process gas inlet means and a second position in communication with said process gas outlet means.

2. The consolidated poppet valve assembly of claim 1, wherein each of said plurality of poppet valves further comprises an actuator shaft having a disk movable between a pair of damper seats.

3. The consolidated poppet valve assembly of claim 1, wherein there are two poppet valves in opposing relationship.

4. The consolidated poppet valve assembly of claim 1, further comprising an integrated exhaust stack in communication with each of said plurality of poppet valves.

5. A regenerative thermal oxidizer, comprising:

first and second heat exchanger columns, each column containing heat exchange media and having a gas inlet, a gas outlet, and being in communication with a combustion chamber;

heating means in said combustion chamber for producing or maintaining a high temperature range therein;

valve means for alternately directing said process gas into one or the other of said first and second heat exchanger columns, said valve means comprising a consolidated poppet valve comprising a valve housing having process gas inlet means and process gas outlet means and a plurality of poppet valves, each of said poppet valves having independent means for actuation between a first position in communication with said process gas inlet means and a second position in communication with said process gas outlet means.

6. The regenerative thermal oxidizer of claim 5, wherein each of said plurality of poppet valves further comprises an actuator shaft having a disk movable between a pair of damper seats.

7. A regenerative thermal oxidizer, comprising:

first and second heat exchanger columns, each column containing heat exchange media and having a gas inlet, a gas outlet, and being in communication with a combustion chamber having a top;

heating means in said combustion chamber for producing or maintaining a high temperature range therein;

first valve means for alternately directing said process gas into one or the other of said first and second heat exchanger columns, said valve means comprising a consolidated poppet valve assembly comprising a valve housing having process gas inlet means and process gas outlet means and a plurality of poppet valves, each of said poppet valves having independent means for actuation between a first position in communication with said process gas inlet means and a second position in communication with said process gas outlet means;

second valve means in communication with said first valve means, said second valve means comprising a consolidated poppet valve assembly comprising a valve housing having gas inlet means and gas outlet means, a plurality of poppet valves, and having an integrated exhaust stack, said second valve means being in communication with said first valve means;

an entrapment chamber being in communication with said second valve means and with said combustion chamber, said entrapment chamber having a bottom, said bottom of said entrapment chamber being said top of said combustion chamber.

* * * * *